US005779947A

United States Patent [19]

Adachi et al.

[11] Patent Number: 5,779,947

[45] Date of Patent: Jul. 14, 1998

[54] METHOD OF CASTING CASTABLE REFRACTORIES OF VESSEL FOR MOLTEN METAL

[75] Inventors: Keisuke Adachi, Kurashiki; Michihiro Kuwayama, Chiba; Momoki Kamo; Masakazu Yoshida, both of Kurashiki; Tsutomu Yoshida; Norio Miki, both of Akou, all of Japan

[73] Assignees: Kawasaki Steel Corporation, Kobe; Kawasaki Refractories Co., Ltd., Akou, both of Japan

[21] Appl. No.: 752,283

[22] Filed: Nov. 19, 1996

[51] Int. Cl.[6] ..... F27D 1/16

[52] U.S. Cl. ..... 264/30; 264/40.6

[58] Field of Search ..... 264/30, 40.6

[56] References Cited

U.S. PATENT DOCUMENTS 4,981,731 1/1991 Yorita ..... 264/30

FOREIGN PATENT DOCUMENTS 743611 9/1966 Canada ..... 264/30

53-46436 4/1978 Japan .

*Primary Examiner*—James Derrington

*Attorney, Agent, or Firm*—Oliff & Berridge, PLC

[57] ABSTRACT

When casting castable refractories as lining refractories of a ladle for a molten metal, wherein the castable refractories are prepared by kneading monolithic refractories with an aqueous solution of a binder containing alumina cement, the castable refractories are preheated on the basis of the open air temperature and cured after casting while keeping the temperature thereof within a set temperature range of from about 20° C. to 40° C. The method stabilizes the hardening time of castable refractories and forms cast refractories excellent in strength and erosion resistance.

12 Claims, 7 Drawing Sheets

AFTER CURING AT 5°C
BURNED AT 1500°C FOR 3HRS μm

AFTER CURING AT 30°C
BURNED AT 1500°C FOR 3HRS μm

METHOD OF CASTING CASTABLE REFRACTORIES OF VESSEL FOR MOLTEN METAL

BACKGROUND OF THE INVENTION

1. Field of the invention

The present invention relates to a method of casting castable refractories of a vessel for molten metal. This method eliminates the effect of a change in the operation temperature caused by seasonal fluctuations, for example, and permits stable casting and a remarkable improvement of durability when installing lining refractories of a vessel for molten metal such as a ladle, a tundish or any of various furnaces that receive molten metal in the iron and steel area and the like with the use of castable refractories.

2. Description of the Related Art

A vessel for molten metal such as a ladle, a tundish or any of various furnaces that receive molten metal used for refining a metal, as typically used by the steel industry, has its inside lined with refractories. Because lining such a vessel for molten metal with refractories is heavy, muscular work, it is desirable to alleviate the heavy, muscular load and save labor through the mechanization or automation of furnace lining.

Because regular-shaped refractories are not suitable for mechanization or automation of a furnace lining operation, a casting process based on the use of a formless refractory material is an effective means of automating the process. It is now a common practice to use monolithic refractories as refractories for molten metal for a ladle or a tundish. However, the need to add water during the lining process makes it difficult to use a basic material for monolithic refractories. Therefore, high-alumina monolithic refractories using alumina cement as a binder are generally used, permitting relatively easy mechanization or automation of the casting process.

When casting alumina-based monolithic refractories for lining a vessel for molten metal such as a ladle, changes in operating properties such as fluidity and hardenability may occur under the effect of temperature of the castable refractories due to the open air temperature. It is conventional in such a case to predict the temperature upon casting and, when manufacturing castable refractories, to make an adjustment by separately adding a hardening accelerator or a hardening retarder in response to the temperature. An adjustment may also be made by adding an adjusting agent during kneading to prevent the adverse effect of the open air temperature and to complete the process within a prescribed hardening time without causing hardening of the refractories before completion.

It is therefore necessary in the conventional art to change the kind and the quantity of the hardening agent or cement to be added to the alumina-based monolithic refractories every time, depending upon the open air temperature, when casting castable refractories for a vessel for molten metal. This is troublesome and hinders stable casting operation.

There is known a method of forcedly drying, when casting castable refractories for lining a ladle, for example, by preheating a core arranged in the ladle, or by casting castable refractories kneaded with hot water, as disclosed in Japanese Unexamined Patent Publication No. 53-46,436.

When adjusting the hardening time by adding a hardening accelerator or a hardening retarder to the alumina-based monolithic refractories, as described above, it is necessary, in the conventional art, to predict the open air temperature and accordingly make an adjustment for the manufacture of castable refractories. If a predicted temperature does not agree with the actual open air temperature upon casting, excess or shortage of the quantity of the adjusting agent leads to a shorter or longer hardening time of the castable refractories, which tends to cause trouble in casting. This is particularly the case when castable refractories which are cast between a ladle and a core locally harden, making it difficult to achieve uniform casting.

Casting castable refractories prepared by preheating a core arranged in a ladle or by kneading with hot water is not sufficient to keep cast refractories at an appropriate temperature. It is therefore difficult to ensure prevention of a shorter or longer hardening time than desired in the source of curing.

SUMMARY OF THE INVENTION

The present invention solves problems of temperature fluctuation caused by the necessity of predicting the open air temperature at the time of actual casting during the stage of kneading monolithic refractories and an aqueous solution of a binder. The present invention further alleviates problems caused by some hardening accelerators and hardening retarders, such as deterioration of properties of cast refractories such as erosion resistance. It also avoids the need to frequently change the kind or the quantity of these additives, and further avoids the problem of having an excessive or insufficient quantity of the adjusting agent. Thus, a method of casting castable refractories of a vessel for molten metal is provided which permits maintaining the castable refractories within an appropriate temperature range, thereby ensuring curing by casting throughout an entire year, irrespective of seasonal changes in the open air temperature.

Further, when casting alumina-based castable refractories for a ladle, the erosion rate of the cast refractories burned after curing increases as the open air temperature decreases. Particularly when the curing temperature after casting is low, the erosion rate of the cast refractories may increase. This was considered attributable to the fact that the hydration reaction of the alumina cement added as a binder varies with temperature.

The present invention is directed to a method for casting castable refractories of a vessel for a molten metal, comprising the step of casting said castable refractories while keeping them within a set temperature range of from about 20° C. to 40° C., wherein the castable refractories are prepared by kneading monolithic refractories with an aqueous solution of a binder containing alumina cement.

The present invention is further directed to a method of casting castable refractories of a vessel for a molten metal, comprising the step of keeping the castable refractories within a set temperature range of from about 20° C. to 35° C., or, more preferably, within a range of from about 25° C. to 35° C.

The present invention further comprises a method of casting castable refractories of a vessel for a molten metal, comprising the additional step of preheating monolithic refractories in a heat retainer on the basis of the open air temperature.

The present invention further comprises a method of casting castable refractories of a vessel for a molten metal, comprising the additional step of preheating an aqueous solution of a binder in a tank on the basis of the open air temperature.

The present invention further comprises a method of casting castable refractories of a vessel for a molten metal, comprising the additional step of preheating a mixer for kneading monolithic refractories and an aqueous solution of a binder on the basis of the open air temperature.

The present invention also comprises a method of casting castable refractories of a vessel for a molten metal, comprising the additional step of preheating a core arranged in the vessel for the molten metal on the basis of the open air temperature.

The present invention further comprises a method of casting castable refractories of a vessel for a molten metal, comprising the additional step of preheating lining refractories of the vessel for the molten metal on the basis of the open air temperature.

In the present invention, therefore, erosion resistance of castable refractories using alumina cement as a binder is stabilized at a high level by keeping the curing temperature in casting within a range of from about 20° C. to 40° C., depending upon the open air temperature. The foregoing temperature should be kept until the start of solidification.

DESCRIPTION OF PREFERRED EMBODIMENTS

Figure 1:
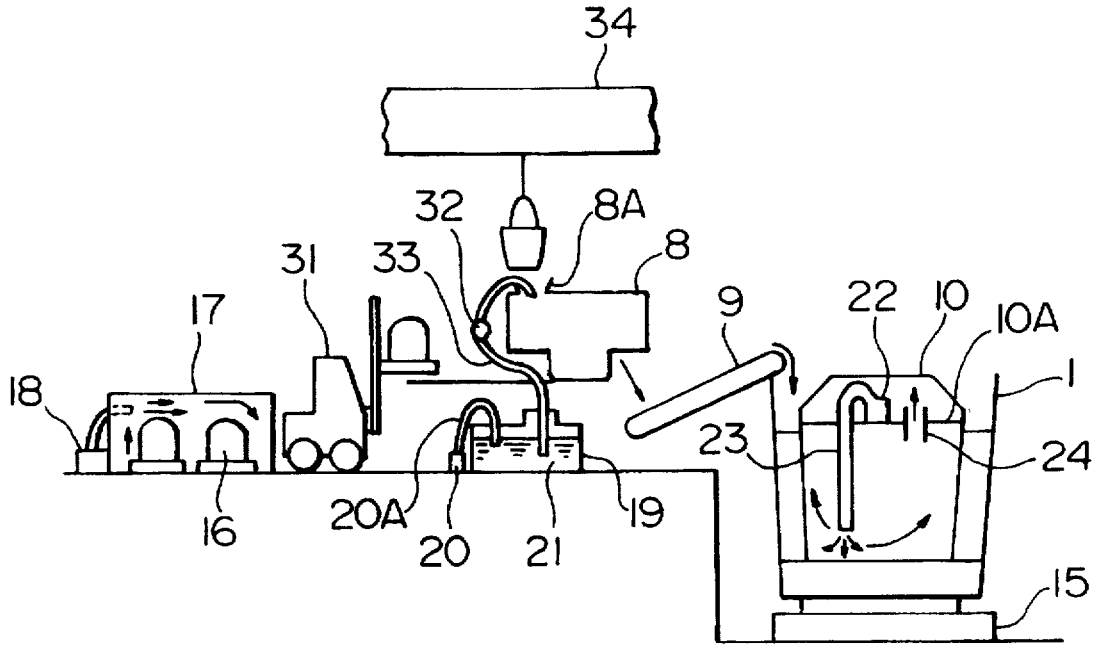
FIG. 1 depicts an outline of arrangement of an apparatus used in embodiments of the present invention.

In the present invention, as described above, castable refractories prepared by kneading monolithic refractories with an aqueous solution of a binder containing alumina cement are cured by casting while maintaining the refractories at a temperature within a set temperature range of from about 20° C. to 40° C., preferably from about 20° C. to 35° C., or, more preferably, from about 25° C. to 35° C., by preheating refractories and/or other factors on the basis of the open air temperature. This enables casting and curing of castable refractories at constant temperature conditions throughout an entire year, regardless of the difference in temperature between seasons, days or day and night.

In the present invention, temperature is preferably kept within the foregoing set temperature range through preheating of the castable refractories when the temperature is low, as in winter. In summer, for example, when a set temperature can be kept without subjecting the refractories to a preheating step, the desired fluidity and hardenability are maintained through casting without preheating. When the open air temperature is very high and the temperature of castable refractories exceeds 40° C., casting may be carried out at night when the open air temperature decreases, or by cooling the refractories by appropriate means.

Factors having an effect on the casting temperature of castable refractories include: (a) the temperature of the monolithic refractories to be cast; (b) the temperature of the aqueous solution of binder containing alumina cement; (c) the temperature of a core arranged in a vessel for molten metal; (d) the temperature of a mixer for kneading the castable refractories; and (e) the heat of individual substances of the refractories temperature of the vessel for molten metal and the heat derived therefrom.

Therefore, the method of the present invention adjusts these temperatures (a) through (e) by preheating to compensate for one or more of these factors, thereby keeping temperature within the foregoing set range.

Preheating when the open air temperature is under 20° C. may be carried out as follows: preheating the monolithic refractories in a heat retainer for example in the case of (a); preheating an aqueous solution of a binder by means of a heater provided in a tank in the case of (b); and, in the case of (c), preheating by blowing of blast into the core. Preheating is not necessary when the castable refractories can be kept within the set temperature range by the open air temperature.

Preheating for each of the factors (a) to (e) above is carried out on the basis of the open air temperature, taking into account the respective heat capacity. As the open air temperature drops, preheating must be done for more than one factor (a) through (e). For example, when the open air temperature is low, as in winter, for example, preheating may be required for all of these factors.

The temperature of the castable refractories to be cast indicates the arithmetic mean property of the heat capacity for factors (a) through (e). The necessary temperature can therefore be maintained by conducting heating up to the necessary temperature for one or two of the factors having relatively large heat capacities. It is, however, desirable to conduct preheating on an average basis for as many factors as possible, while still addressing the fact that additives, such as a binder to be added to the monolithic refractories, may deteriorate under the effect of local high temperatures.

The hydration reaction of alumina cement is known to vary with the temperature, as suggested by the following chemical reaction formulae, wherein C represents Ca, A represents $Al_2O_3$, and H represents $H_2O$:

(1) $CA+10H \rightarrow CA+H_{10}$ (temperature<20° C.);

(2) $2CA+9H \rightarrow C_2AH_8+AH$ (temperature from about 20° C. to 35° C.); and (3) $3CA+8H \rightarrow C_3AH_6+2AH$ (temperature>35° C.).

In the present invention, the curing temperature by casting should be within a range of from about 20° C. to 40° C. At a temperature within this range, the cast refractories burned after curing assume a denser structure, and the hydration reaction, which increases strength and erosion resistance, is accelerated. At a curing temperature over 40° C., hardening of the alumina cement occurs abnormally prematurely, making it difficult to achieve uniform casting.

The set temperature should preferably be within a range of from about 20° C. to 35° C., wherein the hydration reaction (2) of alumina cement easily proceeds, or, more preferably, from about 25° C. to 35° C. At a temperature less than about 20° C. or 25° C., progress of the hydration reaction (2) of the alumina cement is slow. The reaction accelerates in the temperature range of from about 25° C. to 35° C.

The method of the present invention will now be described in detail with reference to the drawings illustrating an embodiment thereof.

In this embodiment of the present invention, a ladle used when refining a high-grade steel, such as extra-low carbon steel or HIC-resistant steel, is lined by casting castable refractories mainly comprising alumina-spinel monolithic refractories, which are adjusted by kneading with an aqueous solution of a binder containing alumina cement, and then curing the cast refractories.

Figure 5:
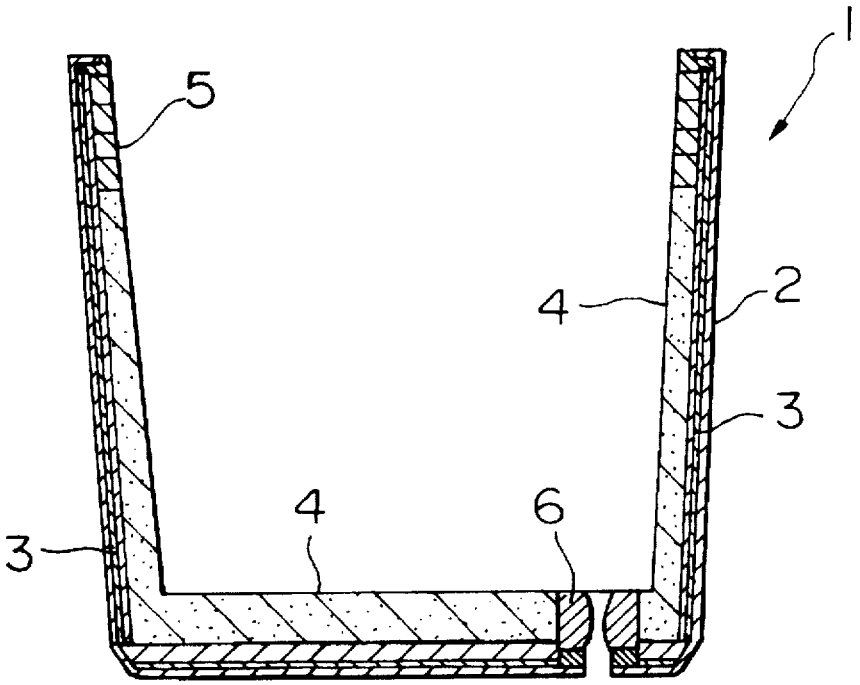
FIG. 5 is a longitudinal sectional view of a ladle.

FIG. 5 illustrates a general structure of the ladle 1 to be relined with the castable refractories adjusted as described above. As shown in FIG. 5, the ladle 1 is lined with permanent lining refractories 3 at portions forming a bottom and side walls along an inner surface of a steel shell 2, and the castable refractories 4 are placed so as to line these bottom and side portions. A slag line portion is lined with bricks 5 excellent in slag erosion resistance, and a nozzle 6 is lined with unburned bricks.

Figure 6:
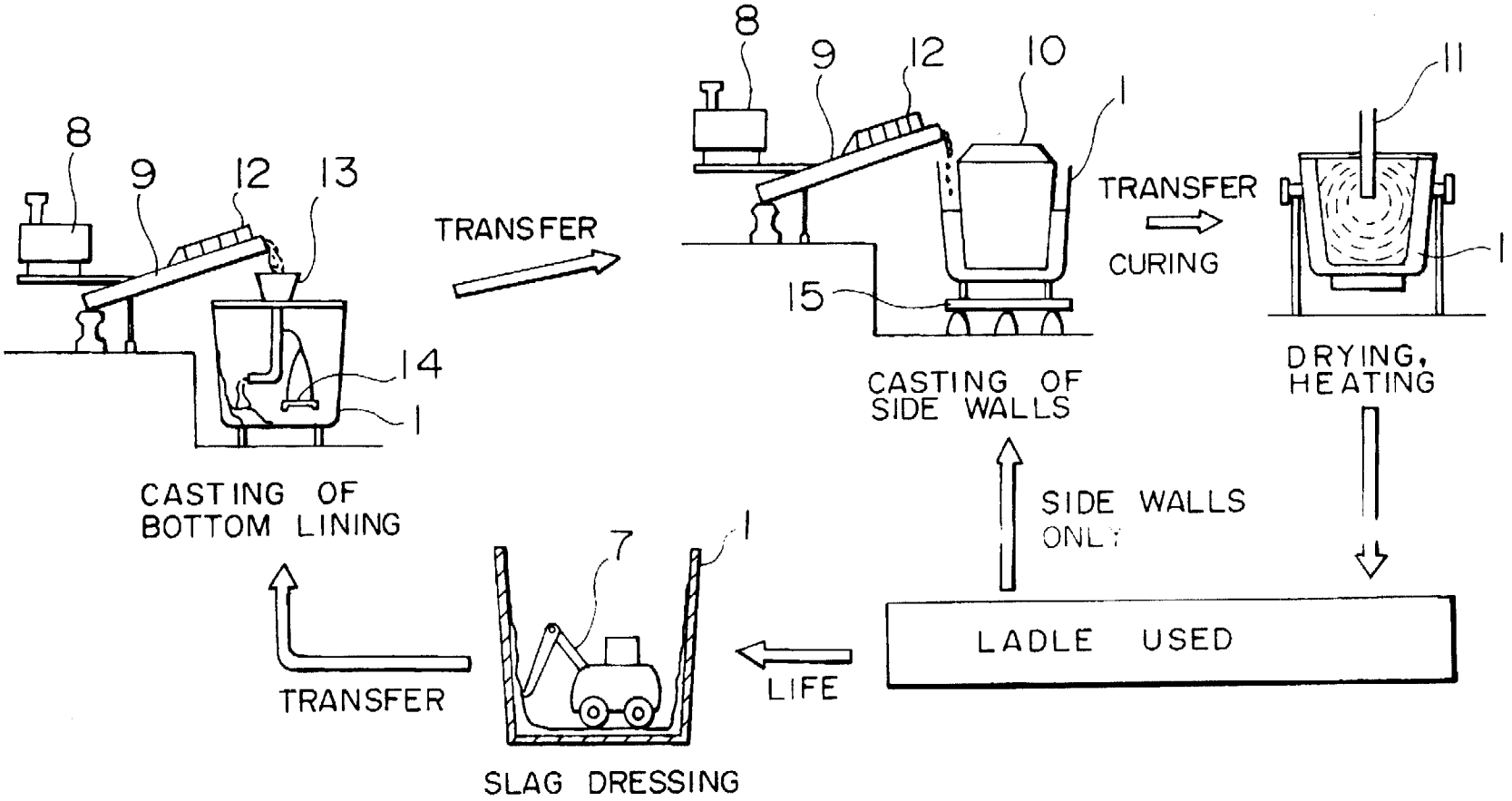
FIG. 6 depicts a relining process for a ladle.

FIG. 6 illustrates a process for relining the ladle 1 commonly used. As shown in FIG. 6, the ladle 1 would be totally relined because the lining refractories are eroded during service life at a rate of 200 charges, for example. Upon relining, solidified slag adhering to the bottom and the side walls is first removed by the use of a slag remover 7.

After transferring the thus prepared ladle 1 to a bottom casting plant, alumina-spinel monolithic refractories forming the main components are kneaded with an aqueous solution of a binder containing alumina cement in a mixer 8. The resultant castable refractories 12 are transferred on a belt conveyor 9 and cast into the ladle 1 while rotating an L-shaped charging chute 13 arranged at the center of the ladle 1. At this point, uniform charging is ensured by vibrating the castable refractories cast onto the bottom of the ladle 1 by means of a vibrator 14.

Upon the completion of the bottom lining operation of the ladle 1, as described above, the ladle 1 is transferred to a side casting plant and placed on a turn table 15. After setting a core 10 in the ladle 1, the turn table 15 is rotated, together with the ladle 1. Simultaneously, the castable refractories kneaded in the mixer 8 are transferred on the belt conveyor 9 in the same manner as above, and a side lining of the castable refractories is formed by casting the refractories into a gap between the ladle 1 and the core 10.

Upon the completion of the casting operation of the ladle 1, the ladle 1 and the cast refractories are held for curing for a period of time necessary for the castable refractories to harden. After removing the core 10 upon the completion of curing, the ladle 1 is transferred to a burning bay, and a burner 11 is inserted in the same manner as in the conventional art.

Simultaneously with relining of the ladle 1, bricks 5 at the slag line portion and unburned bricks at the nozzle 6 are also relined as required. When only the side wall portion of the ladle 1 is to be relined, the ladle 1 would be directly transferred to the side portion casting plant for relining.

In this series of relining operations of the ladle 1, curing of the castable refractories in casting is affected by the open air temperature. Particularly at a low castable refractories temperature of less than 20° C., the hardening time becomes unstable, and fluctuation thereof may lead to unavailability of desired strength or erosion resistance in the cast refractories.

In the present invention, therefore, the castable refractories as described above are cast and cured while keeping the refractories within a set temperature range of from about 20° C. to 40° C., or preferably from about 20° C. to 35° C., and even more preferably from about 25° C. to 35° C. More specifically, when the open air temperature is low, as in winter, for example, so low that the curing temperature in casting is less than 20° C., a plurality of flexible containers 16 containing alumina-spinel monolithic refractories are arranged in a heat retainer 17 provided with a preheater 18 to preheat the refractories to a set temperature of about 30° C., as shown in FIG. 1.

Alumina cement is charged into an aqueous binder solution tank 19 provided with a pipe heater and a stirrer (not shown), and water is added by means of a pump 20. The aqueous binder solution 21 in the aqueous binder solution tank 19 is adjusted through heating with the pipe heater and stirring with the stirrer. In this adjustment, temperature is controlled, thereby preventing excessive temperature increase of the solution, by means of a thermostat to preheat to a temperature of 30° C.

Further, a hot blast is generated by heating to about 60° C. a circulating blast generator 22 having a built-in heater installed on a floor 10A provided in a core 10 arranged in the ladle 1. This blast is directed through a blowing duct 23 running downward through the floor 10A toward the bottom of the core 10, discharged, and circulated inside the core 10 for heating. Then, the blast is directed back from a circulating duct 24 running through the floor 10A onto the floor 10A, and circulated again by means of the circulating blast generator 22 to preheat the core 10 for a period of time of about 12 hours, for example.

Figure 2:
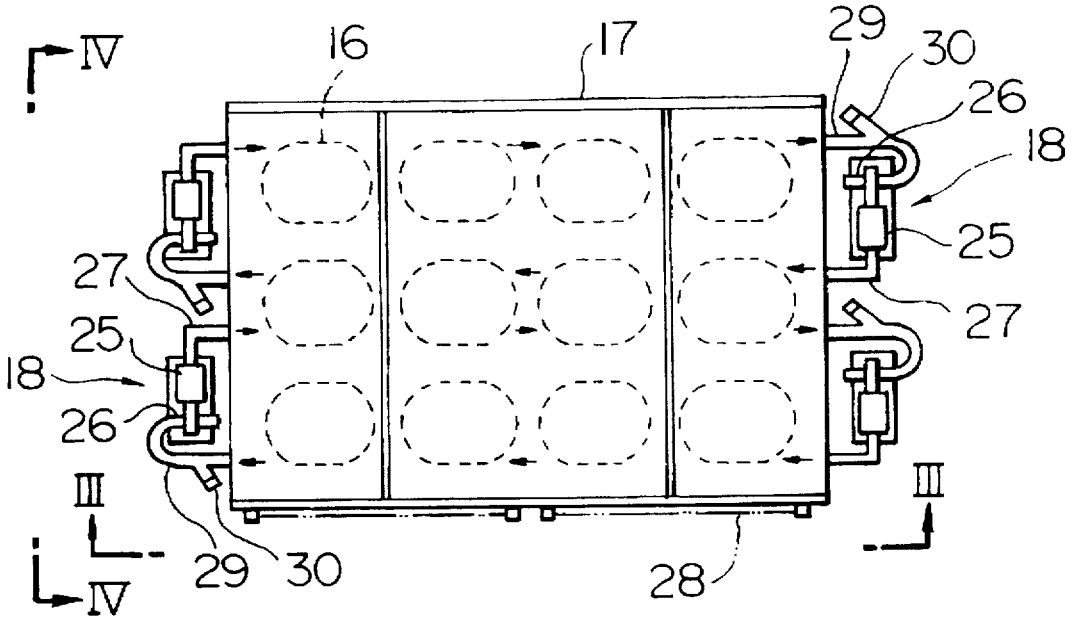
FIG. 2 is a top view of a heat retainer used in embodiments of the invention.
Figure 3:
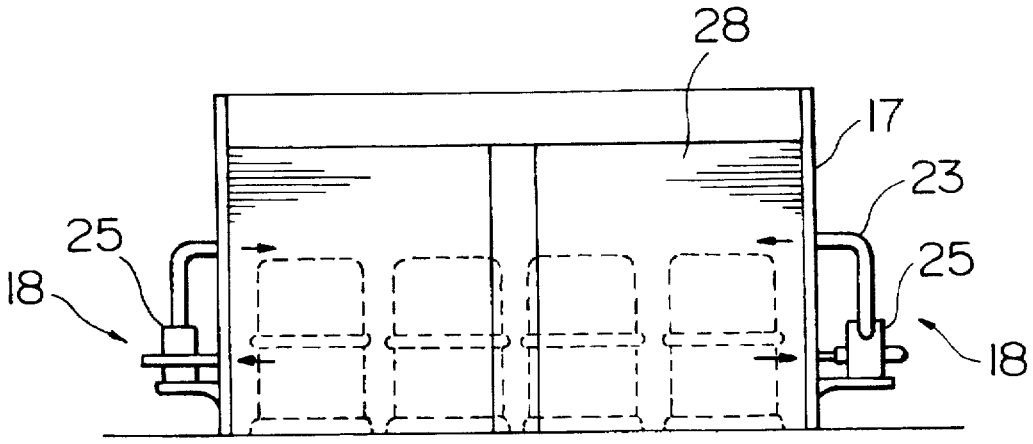
FIG. 3 is a front view of FIG. 2 as viewed along line III—III.
Figure 4:
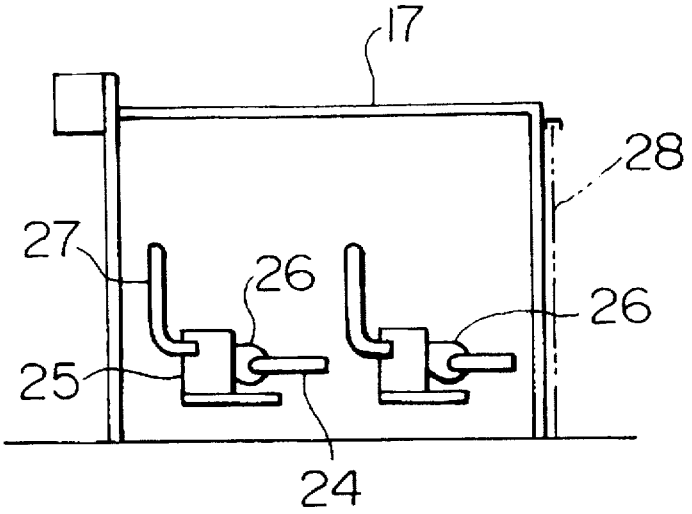
FIG. 4 is a side view of FIG. 2 as viewed along line IV—IV.

As shown in FIGS. 2 through 4, the foregoing heat retainer 17 has two preheaters 18 arranged in front and back thereof, and each preheater 18 is provided with a circulating blast generator 25. Air supplied from blowers 26 provided for each generator is directed to a blast generator where the blast is heated to a set temperature of 85° C. The blast is sent through a blast duct 27 to the heat retainer 17.

The hot blast supplied through the blast duct 27 into the heat retainer 17 passes through the retainer in the direction of the arrows shown in FIG. 2 and preheats the alumina-spinel monolithic refractories in the flexible containers 16 for about 48 hours, for example, so as to achieve a set temperature of 30° C. The hot blast having passed through the heat retainer 17 is circulated from the circulating duct 29 to the preheaters 18. The reference numeral 30 represents a suction duct, connected to the circulating duct 29, into which the supplied air is introduced. A vertically opening/closing shutter 28 is provided on a side of the heat retainer 17, and the flexible containers 16 can be transferred in and out the heat retainer 17 by opening or closing the shutter 28.

Advantages of the present invention will now be described as to a case of relining the side wall portion of the ladle. Similar advantages are obtained with simultaneous relining of the bottom and side wall portions of the ladle 1.

As shown in FIG. 1, for example, twelve flexible containers 16 containing alumina-spinel monolithic refractories are arranged in the heat retainer before kneading. Hot blast is supplied at a discharge temperature of 85° C. from the preheater 18, passes through the heat retainer, and preheats the alumina-spinel monolithic refractories in the flexible containers 16 to a temperature in a range of from about 28° C. to 32° C. for about 48 hours.

Alumina cement in a prescribed quantity is charged into the aqueous binder solution tank 19, and, at the same time, the pump 20 is operated. Aqueous binder solution 21 is stirred by a stirrer while water is added through a supply hose 20A into the aqueous binder solution tank 19. Simultaneously, preheating is continued while maintaining the temperature at a set value of 30° C. by means of a pipe heater. Preheating is further continued by supplying the hot blast of a discharge temperature of 60° C. from the circulating blast generator 22 for twelve hours, for example, so that the outer side of the core 10 arranged in the ladle 1 is heated to a temperature within a range of from about 28° C. to 32° C.

When relining the side wall portion of the ladle 1, the procedure comprises the steps of stopping the preheater 18, opening the shutter 28 of the heater retainer 17, removing the flexible containers 16 from the heat retainer 17 with the use of a fork lift car 31, and then transferring the flexible containers 16 by an overhead traveling crane 34 to above a charging port 8A provided on the mixer 8. The alumina-spinel monolithic refractories in the flexible containers 16 are then charged through the charging port 8A into the mixer 8 by opening the lower charging ports (not shown) of the flexible containers 16.

Simultaneously, the pump 32 is operated to supply the aqueous binder solution 21 held in the aqueous binder solution tank 19 at a set temperature through a supply hose 33 into the mixer 8 in which kneading is conducted to prepare castable refractories mainly comprising alumina-spinel monolithic refractories. The castable refractories thus prepared in the mixer 8 are transferred on a belt conveyor 9 and are cast into a gap formed between the ladle 1 and the core 10, filling the gap. At this point, the ladle 1 is horizontally rotated on the turn table 15 to ensure circumferentially uniform charging in the gap.

Figure 8:
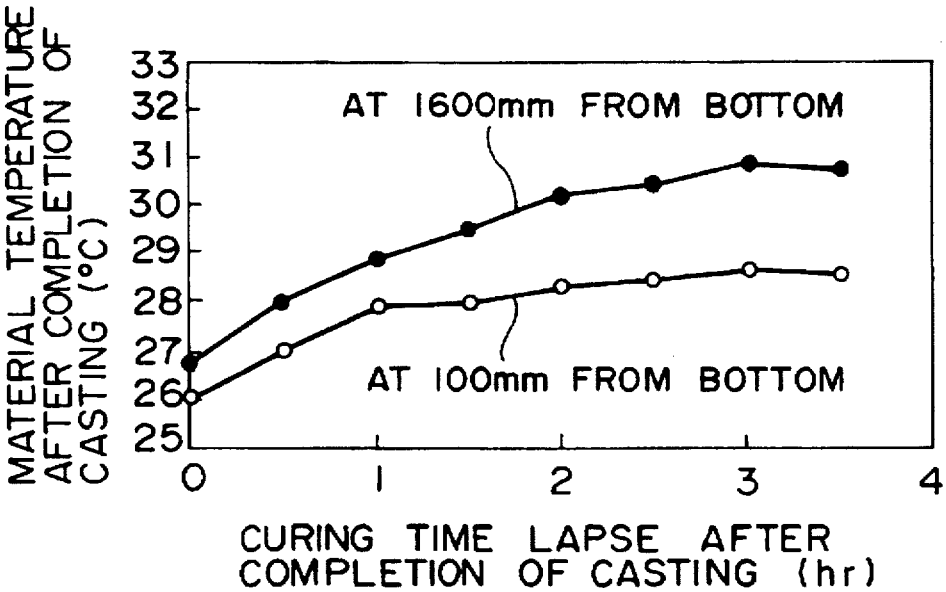
FIG. 8 is a graph of the lapse of curing time (minutes) from the completion of casting versus the material temperature (°C.) after the completion of casting of castable refractories.

After the completion of casting of the castable refractories forming the side wall portion of the ladle 1, heating of the core 10 with the circulating blast generator 22 is continued, as well as heating of the charged cast refractories. The resultant refractories are cured for at least a prescribed period of time until the refractories, held at a temperature within a range of from 28° C. to 32° C., begin solidifying. FIG. 8 illustrates the relationship between the lapse of curing time (min) in preheating of the castable refractories and the material temperature (°C.) of the cast refractories at a low temperature, as in winter. FIG. 8 suggests that it is possible to keep a curing temperature of at least 25° C. even at a low open air temperature. Upon the completion of curing of the cast refractories, the refractories are burned by drying and heating by means of a burner as in the conventional art, thereby achieving the target strength and erosion resistance of the refractories.

Table 1 shows typical chemical composition and properties of cast refractories mainly comprising alumina-spinel monolithic refractories cast with alumina cement as a binder, cured by keeping the set temperature within a range of from about 28° C. to 32° C., and then dried and burned. Satisfactory properties were obtained as shown in Table 1. Table 2 compares temperature conditions of casting steps with the hardening time in curing between refractories cast through a preheating step as described above and refractories without a preheating step.

TABLE 1

| | | | |
|---|---|---|---|
| Chemical composition (%) | | $Al_2O_3$ | 92 |
| | | MgO | 5 |
| | | CaO | 2 |
| | | $SiO_2$ | — |
| Liner change ratio (%) | drying | 110° C. × 24 Hr | −0.1 |
| | burning | 1500° C. × 3 Hr | −0.7 |
| Apparent porosity (%) | drying | 110° C. × 24 Hr | 14.1 |
| | burning | 1500° C. × 3 Hr | 23.1 |
| Bulk specific gravity ($cm^3$) | drying | 110° C. × 24 Hr | 3.06 |
| | burning | 1500° C. × 3 Hr | 2.90 |
| Modulus of rupture (MPa) | drying | 110° C. × 24 Hr | 6.6 |
| | burning | 1500° C. × 3 Hr | 16.4 |
| | Coarse particles | | Electro-fused bauxite |

TABLE 2

| | Example of the Invention | | | | | | | |
|---|---|---|---|---|---|---|---|---|
| | Set discharge temp. (°C.) | Material temp. upon stock-in (°C.) | Material temp. upon stock-out (°C.) | Open air temp. upon casting (°C.) | Added water temp. upon casting (°C.) | Material temp. upon discharge from mixer (°C.) | Core preheating temp. (°C.) | Material hardening time (min) |
| Example 1 | 85 | 7 | 32 | 9 | 30 | 27.3 | 26.5 | 100 |
| Example 2 | 85 | 11 | 29 | 6 | 30 | 26.2 | 26.0 | 94 |
| Example 3 | 85 | 6 | 28 | 7 | 28 | 26.0 | 24.9 | 115 |
| Example 4 | 85 | 6 | 30 | 9 | 30 | 27.0 | 25.9 | 91 |
| Example 5 | 85 | 9 | 30 | 12 | 29 | 26.6 | 26.0 | 100 |
| Example 6 | 85 | 10 | 31 | 9 | 30 | 27.8 | 27.8 | 85 |
| Example 7 | 85 | 10 | 28 | 16 | 31 | 28.1 | 27.9 | 100 |
| Example 8 | 85 | 12 | 26 | 15 | 30 | 27.2 | 26.7 | 80 |
| Example 9 | 85 | 16 | 28 | 18 | 30 | 29.2 | 26.0 | 80 |
| Example 10 | 85 | 18 | 29 | 20 | 30 | 28.3 | 27.2 | 100 |
| Example 11 | 85 | 17 | 30 | 20 | 29 | 30.0 | 26.4 | 70 |
| Example 12 | 85 | 18 | 29 | 22 | 30 | 30.2 | 27.2 | 80 |
| Example 13 | 85 | 18 | 27 | 24 | 28 | 28.2 | 26.5 | 110 |
| Example 14 | | | | 27 | | | | 65 |
| Example 15 | | | | 30 | | | | 100 |
| Comp. Ex. 1 | | | | 5 | | | | 600 |

TABLE 2-continued

| | Example of the Invention | | | | | | | |
|---|---|---|---|---|---|---|---|---|
| | Set discharge temp. (°C.) | Material temp. upon stock-in (°C.) | Material temp. upon stock-out (°C.) | Open air temp. upon casting (°C.) | Added water temp. upon casting (°C.) | Material temp. upon discharge from mixer (°C.) | Core preheating temp. (°C.) | Material hardening time (min) |
| Comp. Ex. 2 | | | | 10 | | | | 460 |
| Comp. Ex. 3 | | | | 15 | | | | 360 |
| Comp. Ex. 4 | | | | 20 | | | | 240 |
| Comp. Ex. 5 | | | | 25 | | | | 110 |
| Comp. Ex. 6 | | | | 30 | | | | 75 |

In Table 2, Examples 1–13 of the invention cover cases where castable refractories were preheated via preheating steps as described in the foregoing embodiment of the present invention, and cured by keeping within a set temperature range. The open air temperature upon casting and curing was under 20° C. Examples 14 and 15 cover cases where refractories were cured by keeping within a set temperature range without a preheating step because the open air temperature was high (at least 20° C.). Comparative Examples 1–6 cover cases where refractories were cast and cured without preheating irrespective of the open air temperature.

As shown in Table 2, according to Examples 1–15 of the invention (with preheating: Examples 1 to 13; without preheating: Examples 14 and 15), the hardening time of the cast refractories in curing is stable because the temperature is kept within a set range. In Comparative Examples 1–3, in contrast, the hardening time is very long, hindering stable operation, because the temperature of the refractory material in curing is lower than the lower limit of 20° C. of the set temperatures. In Comparative Examples 4–6, a relatively satisfactory hardening time is achieved only by accident because of the high open air temperature.

Figure 7:
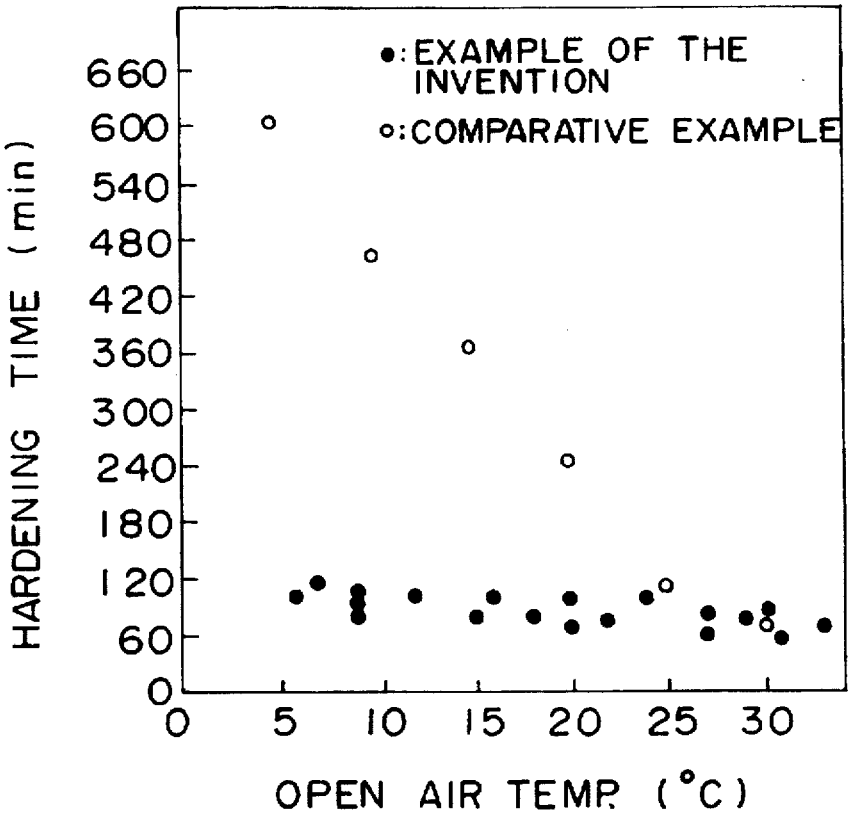
FIG. 7 is a graph of open air temperature (°C.) versus hardening time (minutes) of castable refractories.

FIG. 7 compares the relationship between the open air temperature (°C.) and the hardening time (minutes) for cases where castable refractories of the same material quality were used without adding a hardening accelerator or a hardening retarder, between Examples of the invention with preheating and Comparative Examples without preheating. As shown in FIG. 7, in the Comparative Examples, the hardening time largely fluctuates as a function of the open air temperature, i.e., the hardening time becomes longer as the open air temperature becomes lower. However, the hardening time in the Examples of the invention is stable at a substantially constant level and is not affected by the open air temperature.

Figure 9:
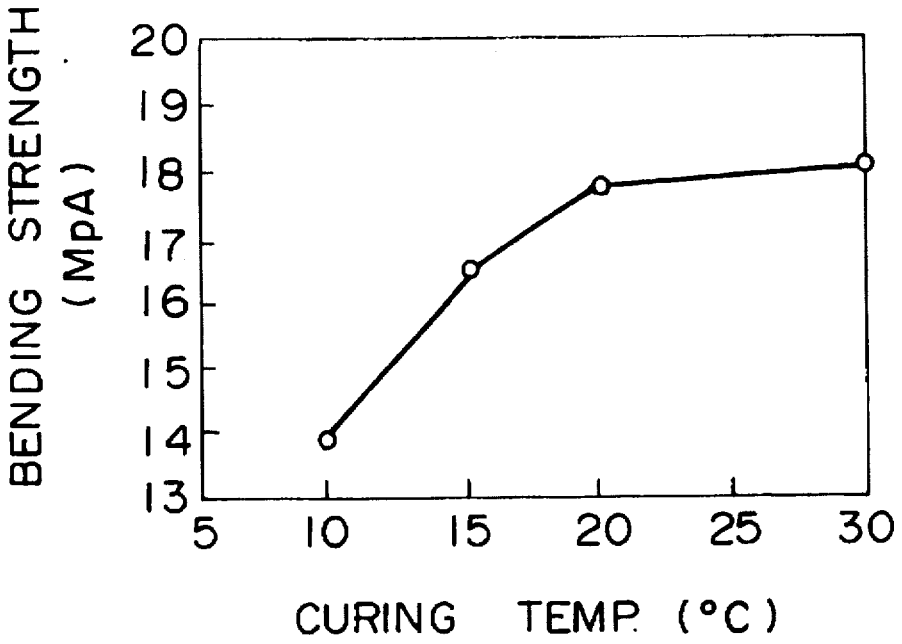
FIG. 9 is a graph of curing temperature (°C.) versus bending strength (MPa) of castable refractories.

FIG. 9 illustrates the relationship between the curing temperature and bending strength of sample materials, which were prepared by the following method. In a laboratory, after curing alumina-spinel castable refractories by casting at various curing temperatures, the samples were prepared by burning at 1,500° C. for three hours to investigate changes in structure density and property values.

Figure 11:
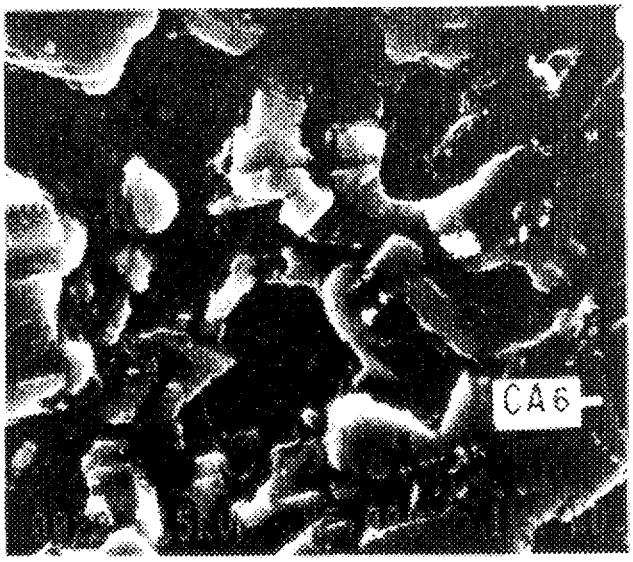
FIG. 11 is a photo of a microstructure of refractories burned at 1,500° C. for three hours after curing at a temperature of 5° C.
Figure 12:
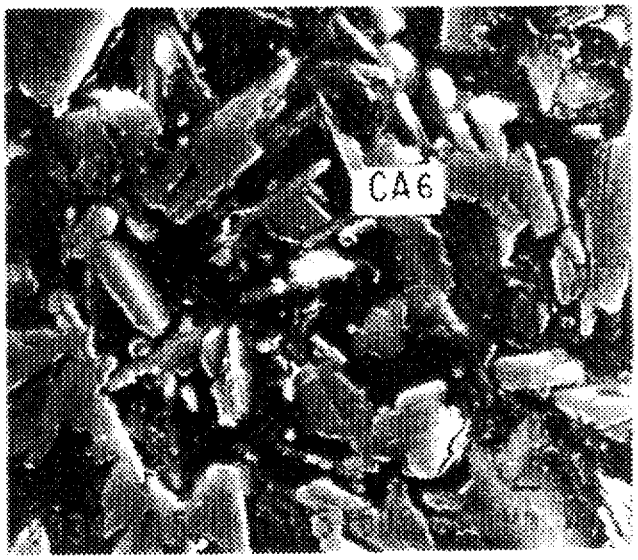
FIG. 12 is a photo of a microstructure of refractories burned at 1,500° C. for three hours after curing at a temperature of 30° C.

As shown in FIG. 9, while bending strength is improved as the curing temperature is higher within a temperature range of from about 10° C. to less than 20° C., it is stable on a high level at temperatures of at least 20° C. without a marked difference in bending strength. FIG. 11 illustrates the microstructure of refractories obtained by burning at 1,500° C. for three hours after curing at a curing temperature of 5° C. FIG. 12 illustrates the microstructure of refractories obtained by burning at 1,500° C. for three hours after curing at a curing temperature of 30° C.

Comparison of FIGS. 11 and 12 demonstrates that, in the sample cured at a temperature of 5° C. shown in FIG. 11, $Ca.6Al_2O_3$ crystal grains largely grow as a whole, resulting in a coarse structure. However, the sample cured at a temperature of 30° C. shown in FIG. 12 has smaller $Ca.6Al_2O_3$ crystal grains, having a denser structure. Such a difference in structural density is considered to cause differences in strength and erosion resistance of castable refractories, and a difference in the erosion rate of castable refractories used for lining a vessel for molten metal. This suggests the importance of keeping the curing temperature within a range of from about 20° C. to 40° C. in casting castable refractories.

Figure 10:
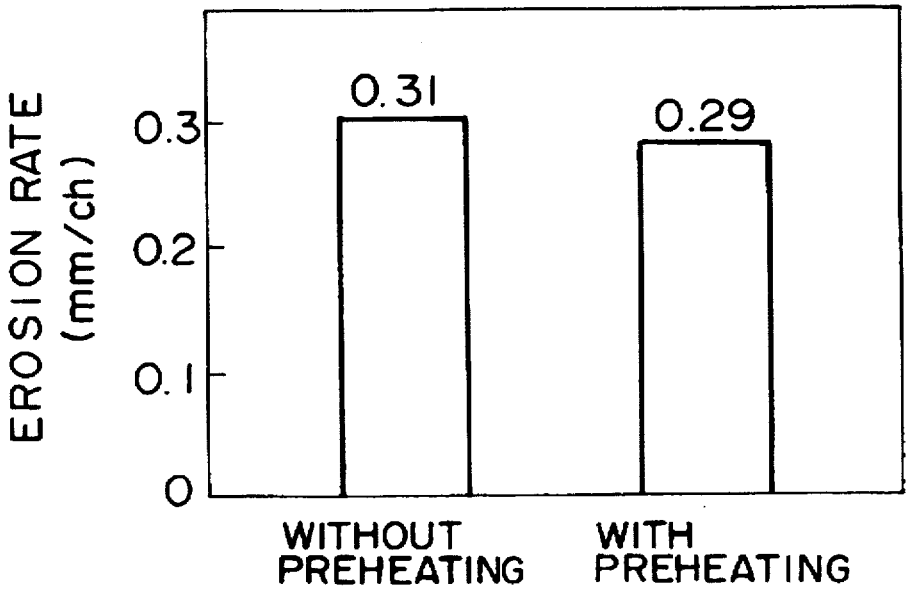
FIG. 10 is a graph of the refractories erosion rate (mm/ch) after burning for cases with and without preheating of the castable refractories.

FIG. 10 illustrates the erosion rate (mm/charge) of the Comparative Examples without preheating and of the Examples of the invention with preheating of the castable refractories. As shown in FIG. 10, the erosion rate of refractories according to the Examples of the invention is reduced compared with the Comparative Examples. The average service life of the cast refractories can thus be improved by about 7%.

According to the present invention, as described above, the curing temperature in casting castable refractories for a vessel of a molten metal is always kept within the set temperature range of from about 20° C. to 40° C. on the basis of the open air temperature. It is therefore possible to stabilize the hardening time of the castable refractories and form a denser structure of the refractories formed upon curing. This improves strength and erosion resistance of the refractories and stabilizes the service life on a high level.

The method of the present invention enables the use of castable refractories of the same material quality in all seasons and places, and makes available stable cast refractories through simple adjustment of the chemical composition of refractories, thus permitting reduction of average refractories cost. Furthermore, hardening time may be adjusted only within the set temperature range of from about 20° C. to 40° C., thereby preventing problems caused by the length of hardening time during casting, reducing complicated control and labor caused by adding a hardening accelerator or a hardening retarder, and eliminating the necessity of close adjustment throughout an entire year.

Table 3 shows one of the operation standards for preheating monolithic refractories in a heat retainer.

Table 4 shows one of the operation standards for preheating an aqueous solution of a binder in a tank.

TABLE 3

| | Temperature of refractories in the open air (before preparation for casting) | | |
|---|---|---|---|
| | lower than 15° C. | 15–25° C. | higher than 25° C. |
| Blast temp. for preheating | 85° C. | 85° C. | 35° C. |
| Preheating time | 48 Hr | 24 Hr | 6 Hr |

TABLE 4

| | Open air temperature | | |
|---|---|---|---|
| | lower than 15° C. | 15–25° C. | higher than 20° C. |
| Preheating temp. | 30° C. | 20° C. | no preheating |

What is claimed is:

1. A method of casting castable refractories to line a vessel for molten metal, comprising:

forming castable refractories by kneading monolithic refractories with an aqueous solution of a binder containing alumina cement; and casting said castable refractories while maintaining the refractories within a set temperature range of from about 20° C. to 40° C.;

wherein said step of casting consists of lining or relining the vessel for molten metal.

2. A method according to claim 1, wherein the castable refractories are maintained within a set temperature range of from about 20° C. to 35° C.

3. A method according to claim 1, further comprising preheating the monolithic refractories in a heat retainer on the basis of the open air temperature.

4. A method according to claim 1, further comprising preheating the aqueous solution of the binder on the basis of the open air temperature.

5. A method according to claim 4, wherein the aqueous solution of the binder is preheated in a tank.

6. A method according to claim 1, further comprising preheating a mixer for kneading monolithic refractories and an aqueous solution of a binder on the basis of the open air temperature.

7. A method according to claim 1, further comprising preheating a core arranged in the vessel for the molten metal on the basis of the open air temperature.

8. A method according to claim 1, further comprising preheating lining refractories of the vessel for the molten metal on the basis of the open air temperature.

9. A method of casting castable refractories to line a vessel for molten metal, comprising:

forming castable refractories by kneading monolithic refractories with an aqueous solution of a binder containing alumina cement; and casting said castable refractories while maintaining the refractories within a set temperature range of from about 20° C. to 40° C. while open air temperature is outside said range;

wherein said step of casting consists of lining or relining the vessel for molten metal.

10. A method of casting castable refractories to line a vessel for molten metal, comprising:

forming castable refractories by kneading monolithic refractories with an aqueous solution of a binder containing alumina cement; and casting said castable refractories on repeated occasions over a period lasting a full year, and casting said castable refractories only while maintaining the refractories within a set temperature range of from about 20° C. to 40° C.;

wherein said step of casting consists of lining or relining the vessel for molten metal.

11. A method according to claim 10, wherein the casting is carried out only during times within said period when the open air temperature is within said range.

12. A method according to claim 10, wherein the casting is carried out under applied temperature control when the open air temperature is outside said range.

* * * * *